United States Patent [19]

Halter et al.

[11] Patent Number: 4,636,098

[45] Date of Patent: Jan. 13, 1987

[54] RIBBON DRIVE COUPLING AND CARTRIDGE TILT ARRANGEMENT FOR PRINT LINE VISIBILITY

[75] Inventors: Edward Arnold Halter; Billy D. Purcell; Edward E. Toutant, all of Austin, Tex.

[73] Assignee: International Business Machines Corporation, Armonk, N.Y.

[21] Appl. No.: 617,422

[22] Filed: Jun. 5, 1984

[51] Int. Cl.[4] ..... B41J 32/00

[52] U.S. Cl. ..... 400/208; 400/212; 400/225; 400/228

[58] Field of Search ..... 400/185, 194, 195, 196, 400/196.1, 207, 208, 208.1, 212, 213, 225, 228, 229, 235.1

[56] References Cited

U.S. PATENT DOCUMENTS

| | | | |
|---|---|---|---|
| 3,976,183 | 8/1976 | Fleischmann et al. | 400/208 |
| 4,091,913 | 5/1978 | Ku et al. | 400/124 |
| 4,231,667 | 11/1980 | Behrendt et al. | 400/208 |
| 4,247,210 | 1/1981 | Kacmarcik et al. | 400/208 X |
| 4,307,969 | 12/1981 | Daughters | 400/208 |
| 4,317,636 | 3/1982 | Hume | 400/208 |
| 4,329,072 | 5/1982 | Kacmarcik | 400/212 X |
| 4,472,073 | 9/1984 | Valle et al. | 400/208 X |

FOREIGN PATENT DOCUMENTS

| | | | |
|---|---|---|---|
| 0110285 | 6/1983 | Japan | 400/212 |

OTHER PUBLICATIONS

*IBM Technical Disclosure Bulletin,* vol. 26, No. 1, Jun. 1983, "Unique Cam Arrangement for Printer Ribbon Feed Mechanism," B. D. Purcell and E. E. Toutant, pp. 67–68.

IBM Technical Disclosure Bulletin, "Supply Spool Tensioning", Cahill, vol. 25, No. 8, Jan. 1983, pp. 4058–4059.

IBM Technical Disclosure Bulletin, "Proportional Ribbon and Correction Feed Mechanism that does Both Lift and Feed with a Single Motor", Mink et al., vol. 26, No. 1, Jun. 1983, pp. 292–293.

IBM Technical Disclosure Bulletin, "Variable Lift and Feed Increment Ribbon/Correction Mechanism", Greenlief et al., vol. 26, No. 3B, Aug. 1983, pp. 1580–1582.

*Primary Examiner*—Ernest T. Wright, Jr.

*Attorney, Agent, or Firm*—Marilyn D. Smith; J. B. Kraft

[57] ABSTRACT

A ribbon cartridge (10) is attached to a carrier (1) of a printing device such that it is tiltable along an axis that is parallel to the print line to drop the ribbon such that the print line is visible. That part of cartridge (10) which is opposite of the ribbon exposing part and on the other side of tilting axis (18) is on its bottom provided with a ribbon advance knob (8). Into this knob (8) two essentially upright standing walls and inclined ramps (11) are molded. The ribbon feed device (6), provided on carrier (1), has a blade (5) or noses (17) which cooperate with slot-forming walls (12) of knob (8). In ribbon drive direction (14) cartridge (10) automatically drops into coupling interconnection for ribbon feed. Upon turning ribbon feed device (6) in reverse direction (16) blade (5) or noses (17) slide up ramp (11) and lift the rear part and drop the front part of the cartridge (10) so that the print line is rendered visible.

11 Claims, 5 Drawing Figures

RIBBON DRIVE COUPLING AND CARTRIDGE TILT ARRANGEMENT FOR PRINT LINE VISIBILITY

TECHNICAL FIELD

The present invention relates to a ribbon cartridge and a ribbon cartridge arrangement for the use in a printer, typewriter or the like, in which the cartridge is attached to a movable carrier such that it is tiltable around an axis parallel to the print line. The arrangement comprises on the carrier a reversible ribbon feed device which in one direction is coupled with a rotatable ribbon drive of the cartridge to feed the ribbon from the supply spool to the take-up spool of the cartridge, and which when driven in the other direction for an appropriate amount lifts part of the cartridge such that the ribbon guiding part of its drops to render the print line visible.

BACKGROUND ART

In *IBM Technical Disclosure Bulletin,* Vol. 26 No. 1, June 1983, page 67–68, a cartridge is described that is attached to a carrier and that is tiltable around an axis parallel to the print line. A reversible drive is shown which in one direction is coupled with the ribbon take-up spool to feed ribbon from the supply spool to the take-up spool, and which if driven in the other direction is used to lift the cartridge to achieve print line visibility by tilting the cartridge about its pivot axis for an appropriate angle. In this known arrangement the cartridge is not coupled directly to the drive means but is installed on a plate that is tiltable around an axis and that connectes to the drive for ribbon drive, ribbon lift oscillation and print line visibility. The specific interconnection coupling between the ribbon drive incorporated into the cartridge and the reversible ribbon feed device ending on said cartridge plate is now shown.

There are different shapes and forms of couplings, male and female parts, that cooperate with each other yet are still easily detachable.

One form is, for example, shown in U.S. Pat. Nos. 4,091,913 and 4,307,969, both depicting a ribbon cartridge with a crosshole opening on the driven ribbon spool side and a mating blade-like part as extension of the driving axle, sometimes called drive key, on the side of the ribbon feed device. Another form is shown in U.S. Pat. No. 4,231,667 depicting a ribbon cartridge drive with a tooth wheel or gear on the driving side and an adapted mating opening on the hub of the driven ribbon spool. Those known coupling designs normally provide no simple and immediate fitting and no automatic self-centering or self-coupling interconnection. In most cases in a separate action the operator has rotationally to adjust the parts such that driving and driven parts slide into each other for foming the completed coupling.

DISCLOSURE OF THE INVENTION

The main object of the present invention is to provide a ribbon cartridge with an interconnection coupling that allows in an automatic and self-controlled manner the positive formation of the driving interconnection of the driving ribbon feed device on the carrier of a print device with the driven ribbon drive of the cartridge. Furthermore, the design should allow the cartridge to tilt upon reversing the direction of the driving ribbon feed device for an appropriate amount to render the print line visible.

These objects as well as others are accomplished in an advantageous manner in accordance with the present invention basically in that a rotatable drive means is provided on the bottom of the cartridge and faces the carrier, the cartridge drive means and a rotatable engaging part of the ribbon feed device are formed such that together they form a kind of screw driver interconnection which comprises a rotatable blade-like or bar-like means on one side and a rotatable slot-forming means on the other side, and which is operative during ribbon feed. Ramp means is provided in one of the means forming the mentioned screw driver interconnection and serves upon rotating the ribbon feed device in reverse direction, that means opposite to normal ribbon feed direction, for an appropriate amount, to tilt the cartridge such that the print line is rendered visible.

In accordance with the advantageous preferred embodiment of the invention, the mentioned ramp means is incorporated into the drive means of the cartridge and combined with the slot-forming means, both incorporated into a ribbon advance knob which is part of the ribbon drive of the cartridge.

Preferably the slot-forming means is made up of two walls that stand essentially upright from the surface of a turnable wheel forming the ribbon advance knob. These walls are arranged radially symmetrically to each other and are provided with a ramp formed on their back to form the mentioned ramp means. These ramps extend inwardly toward the cartridge so that upon turning of the ribbon feed device in ribbon feed direction the cartridge drops automatically down into feeding engagement to operatively provide the screw driver interconnection.

In accordance with a further embodiment of the present invention, preferably a dwell portion is provided between the essentially upright wall and its associated ramp, having a portion that is essentially parallel to the rotary plane of the supporting knob and serving as rest positions for the reversed blade- or bar-like means to ensure a distinct tilted position in which the print line is rendered visible.

In accordance with the preferred embodiment of the present invention, the blade-like or bar-like means are realized by two noses that are radially symmetrically arranged on and stand essentially upright from a wheel which forms a part of the ribbon feed device. Furthermore, to ensure a positive engagement of the advance knob of the cartridge with the wheel of the ribbon feed device of the carrier 1, the operating surfaces of the slot-forming means and the rotatable blade-like means are inclined to their respective plane of rotation such that they attract each other upon rotation in ribbon feed direction. Preferably the angle between the rotational plane and the operating surfaces is slightly less than 90°, thus forming a slight undercut. The preferred appropriate amount of reverse direction of rotation for the engaging part of the ribbon feed device is about 150° to 175°. It should be noted that the design in accordance with the present invention has the advantage that no separate cartridge plate is needed.

BRIEF DESCRIPTION OF THE DRAWING

In the following the invention will be described in detail in connection with the accompanying drawing showing an embodiment of the invention, in which.

BEST MODE FOR CARRYING OUT THE INVENTION

Figure 4:
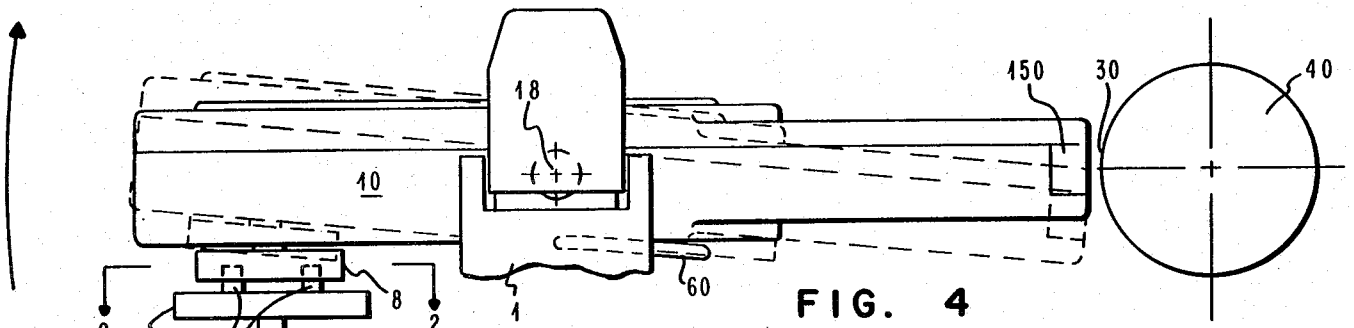
FIG. 4 is a schematic side view of the cartridge suspended such that it is tiltable around an axis parallel to the print or write line, respectively.
Figure 1:
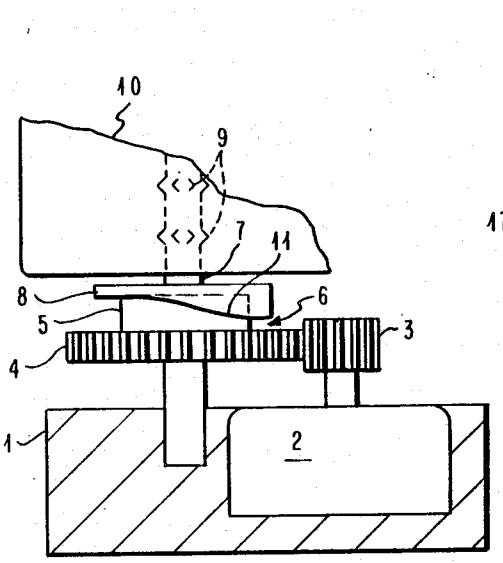
FIG. 1 is a schematic side view of those parts of the ribbon cartridge and the ribbon feed device that cooperate to form the detachable interconnection coupling.

As shown in FIG. 1, on a carrier 1 a stepper motor 2 is fixed. Stepper motor 2 carries a small exit gear 3 that in turn drives a larger gear 4. On this larger gear 4 a blade 5 is mounted along a diameter. Blade 5 forms the driving part of the ribbon feed device 6 that comprises also the mentioned stepper motor 2 and gears 3 and 4. The driven rotatable ribbon drive 7 comprises essentially a ribbon advance knob 8 connected with a ribbon spike driver 9, both rotatably supported by a ribbon cartridge 10. Advance knob 8 is provided outside of cartridge 10 on its bottom and it is close to the rear of the complete cartridge 10, that means remote from the print line 30 and on the other side of the tilting axis 18 (FIG. 4).

In the representation of FIG. 1 a part of advance knob 8 is omitted so that the profile of a ramp 11 is visible. Inside the outer surface of advance knob 8 two of those ramps 11 are provided. They are arranged radially symmetrical to each other as can best be seen in the schematic view of FIG. 2 and the unwinded, straightened representation of FIG. 3. Ramps 11 extend inwardly toward cartridge 10 and spike driver 9.

Figure 3:
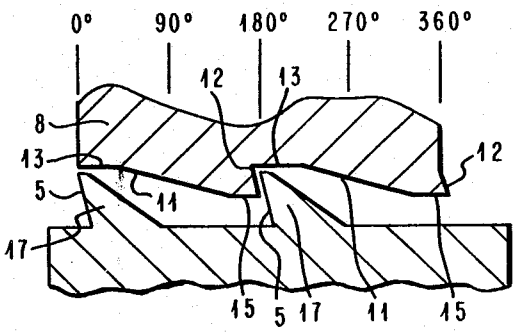
FIG. 3 is a schematic diagram of the circular cross section structure of the cartridge drive knob shown in a 360° unwinded, straightened representation.

FIG. 9 shows schematically in a sectional view ribbon advance knob 8 and blade 5. FIG. 3 exemplifies in a 360° unwinded and straightened manner the circular profile inside knob 8. Blade 5 is shown inside of two walls 12 that stand essentially vertically upright from bottom 13 of knob 8. Walls 12 are arranged radially symmetrical to each other and constitute slot-forming means. On those driving surfaces forming walls 12 blade 5 exerts ribbon advance motion if driven in ribbon drive direction as indicated by arrow 14. During this rotational motion blade 5 is in engagement with walls 12. Between each ramp 11 and vertical wall 12 there is preferably provided a dwell portion 15 that is parallel to the rotational plane of knob 8, in the shown example parallel to bottom 13. These dwell portions 15 provide a rest position for blade 5 when it is driven in reverse direction or in cartridge drop direction, respectively, as shown by arrow 16.

If print or write line visibility is desired, ribbon feed device 6 is driven in reverse direction 16 by stepper motor 2 for a certain amount. During this reverse motion in cartridge drop direction 16, blade 5 travels up ramp 11 to the dwell portions 15. In the specific embodiment as shown here, blade 5 is fixed to the carrier 1 and cartridge 10 is tiltable, blade 5 pushes advance knob 8 and therewith cartridge 10 away from carrier 1. This in turn means a drop of the part of the cartridge 10 exposing the ribbon 150, because this is on the opposite side of the tilting axis 18. By this cartridge dropping action the ribbon 150 is also dropped and taken away as obstruction to render the print line 30 visible to the operator. With blade 5 resting on dwell portions 15 the cartridge 10 is lifted or dropped, respectively, at the print line 30 always for a constant amount into a distinct position.

Figure 5:
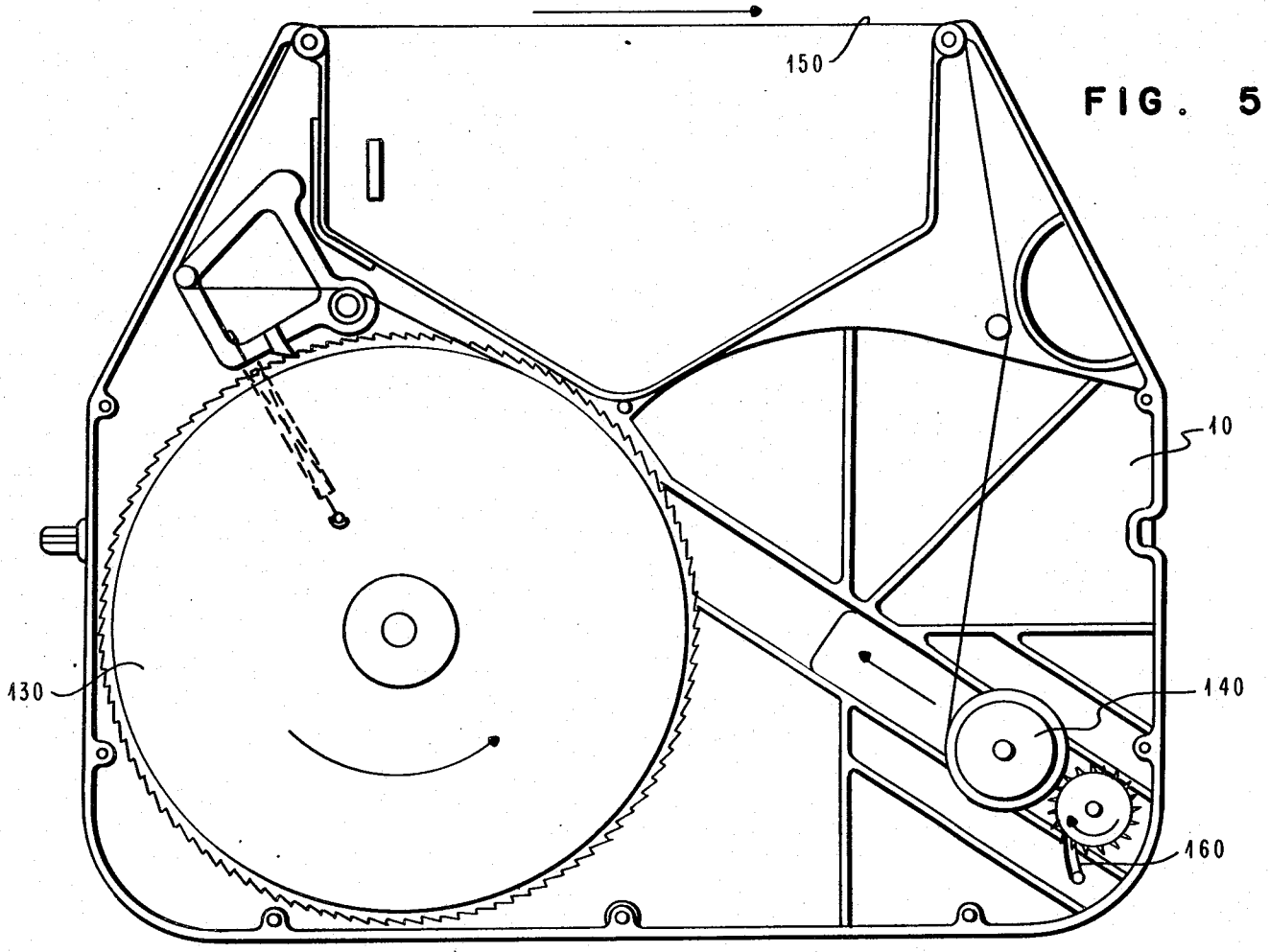
FIG. 5 is a top view of a ribbon cartridge.

To prepare the printer again for printing, the ribbon feed device 6 is reversed to turn in ribbon drive direction 14 for the same rotational angle of between 150°-175°. By this rotational movement of blade 5 cartridge 10 automatically falls back toward carrier 1. At the end of this turn blade 5 again abuts walls 12. Further rotation in the same direction 14 feeds ribbon 150 from the supply spool 130 (FIG. 5) of cartridge 10 to its take-up sppol 140 (FIG. 5).

Figure 2:
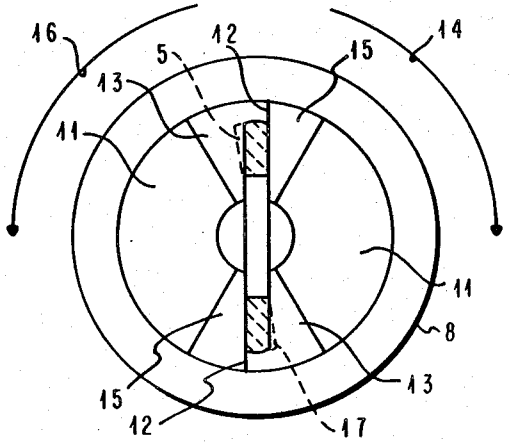
FIG. 2 is a schematic sectional view as indicated by line 2—2 of FIG. 4 of the interconnection coupling.

In the preferred embodiment of the invention blade 5 as shown in FIGS. 1 and 2 is realized by two noses 17 shown in dotted lines in FIG. 2 and as one realization of the blade- or bar-like driving means in FIG. 3. These noses 17 are arranged radially symmetric on gear 4 instead of blade 5. They have essentially upright standing walls forming operating surfaces which essentially mate with the surfaces of walls 12 that means are essentially parallel to them. Furthermore, walls 12 and the operating driving surfaces of blade 5 or noses 17, respectively, are preferably slightly inclined against the parallel planes of rotation of their respective supporting parts, advance knob 8 on the one side and gear 4 on the other side. The inclination is such that advance knob 8 with cartridge 10 is attracted toward gear 4 with its blade 5 or noses 17, respectively, during rotation in ribbon drive direction 14. The angle between the driving surface of blade 5 or nose 17 with its respective associated rotational plane is slightly less than 90° so that an undercut is formed.

FIG. 4 shows cartridge 10 tiltably supported around a tilting axis 18 that is parallel to the print line 30. The print line 30 extends into the depth of the page and as such, appears as a point instead of a line in FIG. 4. At the rear end of cartridge 10 the advance knob 8 is provided which cooperates with drive blades 17 of driving wheel 4 of the ribbon feed drive 6. In broken lines in FIG. 4 is shown the position of cartridge 10 when it is tilted upward by reverse rotation of wheel 4 with blades 17 or down, respectively, at the ribbon exposing part immediately in front of the print line 30 of the platen 40 (FIG. 4). Thus, the print line visibility is indicated. It should be noted, that the center of mass of cartridge 10 is provided between tilting axis 18 and ribbon advance knob 8 so that weight normally pushes cartridge 10 down onto ribbon feed device 6. There also could be provided a biasing spring 60 (FIG. 4) to assure that advance knob 8 stays in contact with the driving blade 5 or 17, respectively, of the ribbon feed device 6.

To ensure a proper working for providing print line visibility there might be provided a ratchet 160 (FIG. 5) on the rotatable ribbon drive 170 (FIG. 5) of the cartridge 10 to prevent reverse turning of spike driver 9 when the ribbon feed device 6 is reversely driven to drop the ribbon 150 out of the print line 30.

While this invention has been particularly shown and described with reference to a preferred embodiment thereof, it will be understood by those skilled in the art that the foregoing and other changes in form and details may be made therein without departing from the spirit and scope of the invention.

We claim:

1. A ribbon cartridge and a ribbon cartridge arrangement for use in a printer, typewriter or the like, in which said cartridge is attached to a moveable carrier such that said cartridge is tiltable around an axis parallel to a print line, said arrangement comprising on said carrier a reversible ribbon feed device that in one direction is coupled with a rotatable ribbon drive of said cartridge to feed ribbon from a supply spool to a take-up spool of said cartridge, and that when driven in the other direction for an appropriate amount lifts part of said cartridge such that a ribbon guiding part of said cartridge drops to render said print line visible, characterized in that (a) a rotatable drive means (7) is provided on a bottom of said cartridge (10) facing said carrier (1), (b) said rotatable drive means and a rotatable engaging part (5, 17) of said feed device (6) are formed such that together they form a kind of screw driver interconnection, (c) said interconnection comprising a rotatable blade-like means (5) on one side and a rotatable slot-forming means (12) on the other side, (d) said screw driver interconnection is operative during ribbon feed (14) from said supply spool to said take-up spool, (e) ramp means (11) is provided in one (8) of said rotatable drive means and said rotatable engaging part, (f) said ramp means, upon rotating said ribbon feed device in reverse direction (16), i.e., opposite to the normal ribbon feed direction (14), for said appropriate amount serves to tilt said cartridge such as to make said print line visible.

2. The arrangement of claim 1, wherein said ramp means is incorporated into said rotatable drive means of said cartridge.

3. The arrangement of claim 1, wherein said ramp means (11) and said slot-forming means (12) are combined and incorporated into a ribbon advance knob (8) that forms part of said ribbon drive of said cartridge.

4. The arrangement of claim 3, wherein said slot-forming means is made up of two walls (12) that stand essentially upright from the surface of a turnable wheel forming said ribbon advance knob (8) and which are arranged radially symmetrical to each other, and that are furthermore provided with a ramp (11) formed on their back, forming said ramp means, said ramp extending inwardly toward said cartridge so that upon turning of said ribbon feed device in ribbon feed direction said cartridge drops down into feeding engagement to operatively provide said screw driver interconnection.

5. The arrangement of claim 4, wherein a dwell portion (15) is provided between said essentially upright wall and its associated ramp, said dwell portion being essentially parallel to the rotary plane (13) of said turnable wheel, whereby one said dwell portion said blade-like means (5, 17) rests when reverse rotated for said appropriate amount to ensure a distinct tilted position in rendering said print line visible.

6. The arrangement of claim 1, wherein said rotatable blade-like means is formed out of two noses (17) that are radially symmetrically arranged on and stand essentially upright from a wheel (4) that forms part of said ribbon feed device.

7. The arrangement of claim 1, wherein said rotatable blade-like means and said slot-forming means are inclined at their respective driving surfaces relative to each other and to the plane of rotation such that they are attracted to each other upon rotation in ribbon feed direction.

8. The arrangement of claim 7, wherein the angle between said rotational plane and an operation surface is slightly less than 90°.

9. The arrangement of claim 1, wherein said appropriate amount of reverse direction (16) is a rotation of said engaging part (5, 17) of said ribbon feed device (6) for about 150° to 175°.

10. A ribbon cartridge attachable to a movable carrier and tiltable about an axis parallel to a print line of a printing device, said cartridge including a rotatable ribbon drive to feed ribbon from a supply reel to a take-up reel, characterized in that (a) said rotatable ribbon drive comprises a knob (8) outside said cartridge (10), (b) said knob is provided on the lower side of said cartridge, said side which rests in operation on said movable carrier (1), to provide a driving interconnection with a ribbon feed devie (6) arranged on said carrier, (c) the surface of said knob facing said carrier is provided with at least two walls (12) that stand essentially upright to the rotary plane (13) of said knob, (d) said walls are arranged radially symmetrical to each other and having a ramp (11) formed on their back, (e) said ramps extending inwardly toward said cartridge, (f) said walls and said ramps forming a kind of slot which cooperates with a blade-like part (5, 17) of said ribbon feed device, thus forming a self-connecting screw driver interconnection operative in normal ribbon feed direction (14), (g) said ramps upon reversing said ribbon feed direction of said ribbon feed device for an appropriate amount serve to cam said blade-like part of said ribbon feed device such that said cartridge is tilted about said tilting axis such that the print line obstruction by said ribbon is eliminated and the print line is rendered visible.

11. The ribbon cartridge of claim 10, wherein between each of said essentially upright walls and said associated ramps a dwell portion (15) is provided that is essentially parallel to said rotary plane of said knob.

* * * * *